US008069929B2

(12) United States Patent
Sugimoto et al.

(10) Patent No.: US 8,069,929 B2
(45) Date of Patent: Dec. 6, 2011

(54) IMPACT TOOL

(75) Inventors: Manabu Sugimoto, Anjo (JP); Hidenori Nagasaka, Anjo (JP); Hiroshi Otsuka, Anjo (JP)

(73) Assignee: Makita Corporation, Anjo (JP)

( * ) Notice: Subject to any disclaimer, the term of this patent is extended or adjusted under 35 U.S.C. 154(b) by 303 days.

(21) Appl. No.: 12/379,867

(22) Filed: Mar. 3, 2009

(65) Prior Publication Data

US 2009/0223690 A1 Sep. 10, 2009

(30) Foreign Application Priority Data

Mar. 10, 2008 (JP) ..... 2008-060061

(51) Int. Cl.
*E02D 173/48* (2006.01)

(52) U.S. Cl. ..... 173/128; 173/93; 173/93.6; 173/104; 173/109; 173/217; 173/48; 81/463; 81/464

(58) Field of Classification Search ..... 173/93, 173/93.6, 104, 109, 216–217, 128, 48; 81/463–464
See application file for complete search history.

(56) References Cited

U.S. PATENT DOCUMENTS 2,341,497 A * 2/1944 Amtsberg ..... 173/93.5
3,156,334 A * 11/1964 Hoza ..... 173/93.6
4,002,212 A * 1/1977 Schoeps ..... 173/93.5
6,725,945 B2 * 4/2004 Sugimoto et al. ..... 173/117
7,124,839 B2 * 10/2006 Furuta et al. ..... 173/104
7,207,393 B2 * 4/2007 Clark et al. ..... 173/90
7,494,437 B2 * 2/2009 Chen ..... 475/149
2006/0254789 A1 * 11/2006 Murakami et al. ..... 173/210

FOREIGN PATENT DOCUMENTS

JP A-2003-231067 8/2003

* cited by examiner

*Primary Examiner* — Rinaldi I. Rada
*Assistant Examiner* — Michelle Lopez
(74) *Attorney, Agent, or Firm* — Oliff & Berridge, PLC

(57) ABSTRACT

An impact tool includes: a spindle disposed in a housing; an anvil disposed in front of the spindle and rotatably supported by the housing through a metal bearing, a rear surface of the anvil having a bearing hole in which a front end of the spindle is received; an impact mechanism configured to transmit a rotation of the spindle to the anvil; an outer groove formed on an outer periphery of the anvil and opposed to the metal bearing; and a connecting opening radially extending in the anvil and connecting the bearing hole and the outer groove to provide a communication therebetween. The outer groove is formed to have a depth in the range of 3-10% of an outer diameter of the anvil, and the connecting opening opens at a rear end of the outer groove in an axial direction of the anvil.

5 Claims, 10 Drawing Sheets

IMPACT TOOL

This application claims the entire benefit of Japanese Patent Application Number 2008-060061 filed on Mar. 10, 2008, the entirety of which is incorporated by reference.

BACKGROUND OF THE INVENTION

1. Field of the Invention

The present invention relates to an impact tool, such as an impact driver, which causes an anvil protruding from a front side of a housing to generate a rotary impact force.

2. Description of Related Art

As disclosed in Japanese Laid-open Patent Publication No. 2003-231067, an impact tool such as an impact driver includes: a spindle disposed in a housing and configured to be rotated by a motor; an anvil disposed in front of the spindle and rotatably supported by the housing through a metal bearing in a manner coaxial with the spindle, a front end of the anvil having an insertion hole for attaching a bit and protruding from a front side of the housing; and an impact mechanism configured to transmit a rotation of the spindle as a rotary impact force to the anvil, and an action of the impact mechanism caused by a rotation of the spindle is transmitted to the anvil as a rotary impact force.

A bearing hole is formed at the rear end of the center axis of the anvil, and the front end of the spindle is rotatably supported in the bearing hole. Further, a connecting opening radially extends in the anvil and connects the bearing hole and the inner peripheral surface of a metal bearing to provide a communication therebetween. Grease in the bearing hole is supplied to the inner peripheral surface of the metal bearing through the connecting opening so that lubrication is ensured between the anvil and the metal bearing.

However, the connecting opening is formed in such a position to correspond to a grease receiving groove that is circumferentially formed on the inner peripheral surface of the metal bearing and at a center of the metal bearing in the axial direction thereof. For this reason, the connecting opening is often formed in the anvil in a position ahead of the bearing hole and is connected at the front end of the bearing hole. Since the insertion hole for a bit is formed in the anvil at a region ahead of the connecting opening, the overall length of the anvil is determined based on a depth of the insertion hole at the region ahead of the connecting opening. In consideration of the fact that a necessary depth for the insertion hole has to be ensured for the anvil, the size of the anvil cannot be reduced.

In view of the above drawback of the prior art, the present invention seeks to provide an impact tool, which can reduce the overall length of the anvil while ensuring necessary lubrication between the anvil and the metal bearing.

The present invention has been made in an attempt to eliminate the above disadvantages, and illustrative, non-limiting embodiments of the present invention overcome the above disadvantages and other disadvantages not described above. Also, the present invention is not required to overcome the disadvantages described above, and an illustrative, non-limiting embodiment of the present invention may not overcome any of the problems described above.

SUMMARY OF THE INVENTION

It is a first aspect of the present invention to provide an impact tool comprising: a spindle disposed in a housing and configured to be rotated by a motor; an anvil disposed in front of the spindle and rotatably supported by the housing through a metal bearing in a manner coaxial with the spindle, a front end of the anvil having an insertion hole for attaching a bit and protruding from a front side of the housing, and a rear surface of the anvil having a bearing hole in which a front end of the spindle is coaxially and rotatably supported; an impact mechanism configured to transmit a rotation of the spindle as a rotary impact force to the anvil; a ring-shaped outer groove formed on an outer periphery of the anvil and opposed to an inner peripheral surface of the metal bearing; and at least one connecting opening radially extending in the anvil and connecting the bearing hole and the outer groove to provide a communication therebetween, wherein the outer groove is formed to have a depth in the range of 3 to 10% of an outer diameter of the anvil, and the connecting opening opens at a rear end of the outer groove in an axial direction of the anvil.

It is a second aspect of the present invention to provide an impact tool comprising: a spindle disposed in a housing and configured to be rotated by a motor; an anvil disposed in front of the spindle and rotatably supported by the housing through a metal bearing in a manner coaxial with the spindle, a front end of the anvil having an insertion hole for attaching a bit and protruding from a front side of the housing, and a rear surface of the anvil having a bearing hole in which a front end of the spindle is coaxially and rotatably supported; an impact mechanism configured to transmit a rotation of the spindle as a rotary impact force to the anvil; a ring-shaped outer groove formed on an outer periphery of the anvil and opposed to an inner peripheral surface of the metal bearing; and at least one connecting opening radially extending in the anvil and connecting the bearing hole and the outer groove to provide a communication therebetween, wherein an opening portion of the connecting opening communicating with the outer groove is enlarged, and the connecting opening opens at a rear end of the outer groove in an axial direction of the anvil.

It is a third aspect of the present invention to provide an impact tool comprising: a spindle disposed in a housing and configured to be rotated by a motor; an anvil disposed in front of the spindle and rotatably supported by the housing through a metal bearing in a manner coaxial with the spindle, a front end of the anvil having an insertion hole for attaching a bit and protruding from a front side of the housing, and a rear surface of the anvil having a bearing hole in which a front end of the spindle is rotatably supported in a manner coaxial with the anvil; an impact mechanism configured to transmit a rotation of the spindle as a rotary impact force to the anvil; and at least one connecting opening radially extending in the anvil and connecting the bearing hole and an inner peripheral surface of the metal bearing to provide a communication therebetween, wherein one end of the connecting opening is bent rearward at a position close to an axis of the anvil and connected to the bearing hole.

It is a fourth aspect of the present invention to provide an impact tool comprising: a spindle disposed in a housing and configured to be rotated by a motor, a front end of the spindle having a bearing hole; an anvil disposed in front of the spindle and rotatably supported by the housing through a metal bearing in a manner coaxial with the spindle, a front end of the anvil having an insertion hole for attaching a bit and protruding from a front side of the housing, and a rear end of the anvil rotatably supporting the spindle in the bearing hole in a manner coaxial therewith; an impact mechanism configured to transmit a rotation of the spindle as a rotary impact force to the anvil; and a ring-shaped outer groove formed on an outer periphery of the anvil and opposed to an inner peripheral surface of the metal bearing, wherein at least one communication passage is formed on the outer periphery of the anvil so as to communicate the outer groove with an inner region of the housing at a rear side of the anvil.

According to the present invention, the overall length of the anvil can be reduced while necessary lubrication is ensured between the anvil and the metal bearing, and the whole size of the impact tool can be downsized.

BRIEF DESCRIPTION OF THE DRAWINGS

The above aspect, other advantages and further features of the present invention will become more apparent by describing in detail illustrative, non-limiting embodiments thereof with reference to the accompanying drawings, in which:

FIGS. 10A to 10C are explanatory views of the anvil according to the fourth embodiment, in which FIG. 10A is a rear elevation view of the anvil, FIG. 10B is a plan view of the anvil, and FIG. 10C is a longitudinal sectional view of the anvil.

DETAILED DESCRIPTION OF THE EXEMPLARY EMBODIMENTS

With reference to the accompanying drawings, the present invention will be described in detail.

First Embodiment

Figure 1:
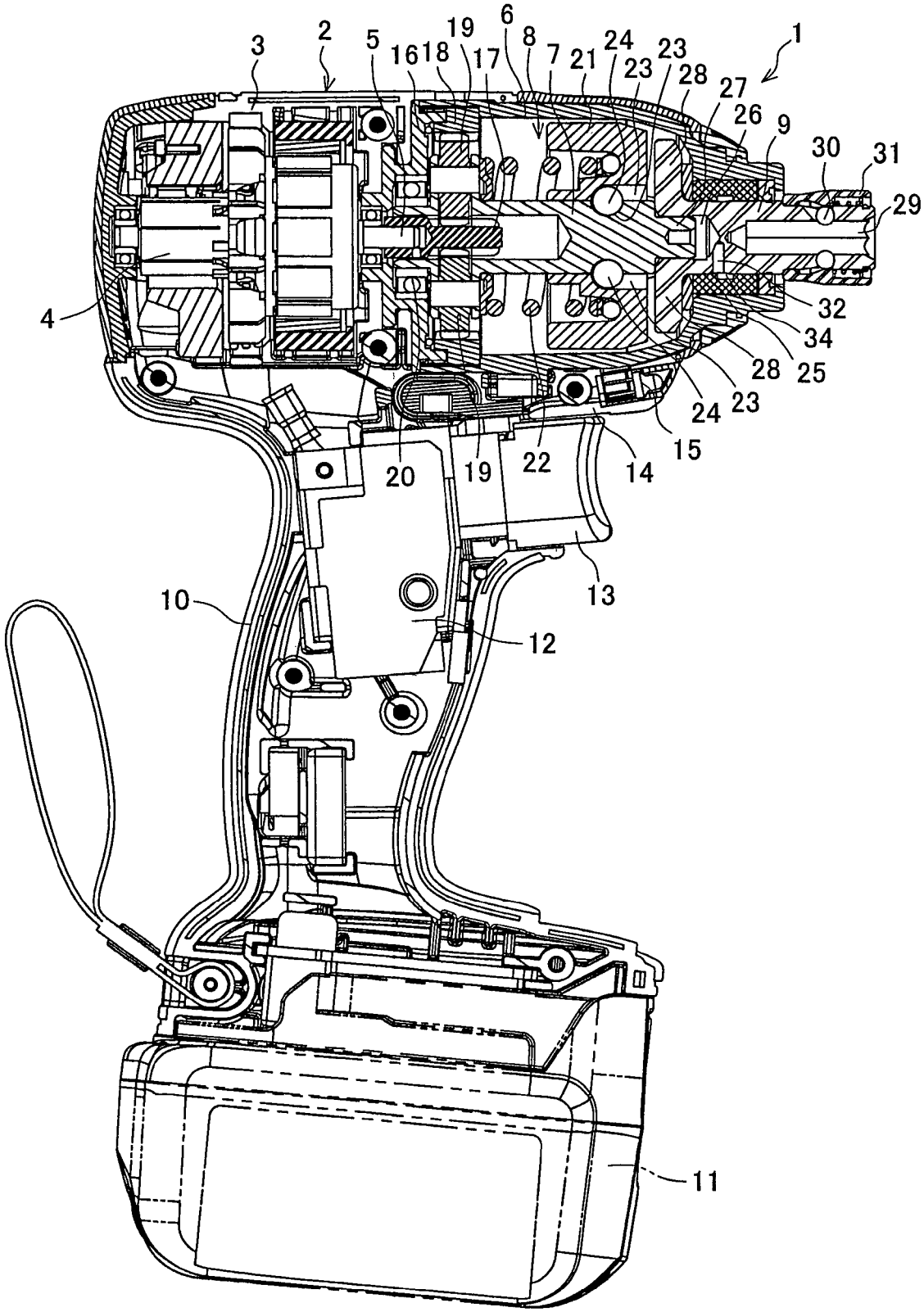
FIG. 1 is a longitudinal sectional view of an impact driver according to a first embodiment of the present invention.

An impact driver as an example of an impact tool will be described. As seen in FIG. 1, an impact driver 1 includes: a main body housing 2 which is assembled from right and left housing halves 3, 3 and in which a motor 4 is disposed; and a hammer case 6 which is assembled to a front side (right-hand side of FIG. 1) of the main body housing 2 and which receives therein a spindle 7, an impact mechanism 8, and an anvil 9. The hammer case 6 has a diving bell-shaped cross-section. Reference numeral 10 indicates a handle extending from a lower part of the main body housing 2. A battery pack 11 as a power source is attached to the lower end of the handle 10, and a switch 12 is disposed at an upper part of the handle 10. The switch 12 operates a motor 4 when a switch trigger 13 is depressed to ON position. An extension portion 14 for covering a lower part of the hammer case 6 is provided in the main body housing 2 above the switch trigger 13, and a lighting unit 15 is arranged inside the extension portion 14, facing the front side of the anvil 9.

An output shaft 5 of the motor 4 is rotatably supported by a gear case 16 which is secured to the main body housing 2. A pinion 17 protruding into the hammer case 6 is tightly fitted onto the output shaft 5. The spindle 7 retains two planetary gears 19, 19 within the hammer case 6. The two planetary gears 19, 19 are meshed with the pinion 17 and revolve within an internal gear 18. The rear end of the spindle 7 is rotatably supported by a ball bearing 20 in a manner coaxial with the output shaft 5, and the ball bearing 20 is supported by the gear case 16.

The impact mechanism 8 has a conventional structure, and includes a hammer 21 which is fitted at a front part of the spindle 7 and engageable with flanges 28, 28 of the anvil 9, and a coil spring 22 which urges the hammer 21 toward the front side of the impact driver 1. The hammer 21 is engaged with the spindle 7 through a plurality of balls 24, 24 which are received between grooves 23, 23 formed on the inner surface of the hammer 21 and the outer surface of the spindle 7.

The anvil 9 is rotatably supported at its center part by a metal bearing 25 which is secured at the front end of the hammer case 6. A bearing hole 26 is formed at the rear end of the center axis of the anvil 9, and a small-diametered portion 27 provided at the front side of the spindle 7 is rotatably supported in the bearing hole 26. Within the hammer case 6, a pair of flanges 28, 28 radially extend at the rear end of the anvil 9, and the hammer 21 of the impact mechanism 8 engages with the flanges 28, 28.

The anvil 9 protrudes from the hammer case 6, and an insertion hole 29 for attaching a bit (not shown) is formed at the front end of the anvil 9. Further, in order to prevent the bit inserted into the insertion hole 29 from coming off from the anvil 9, a chuck mechanism, which includes balls 30, 30 and a sleeve 31, is provided at the front end of the anvil 9.

Figure 2:
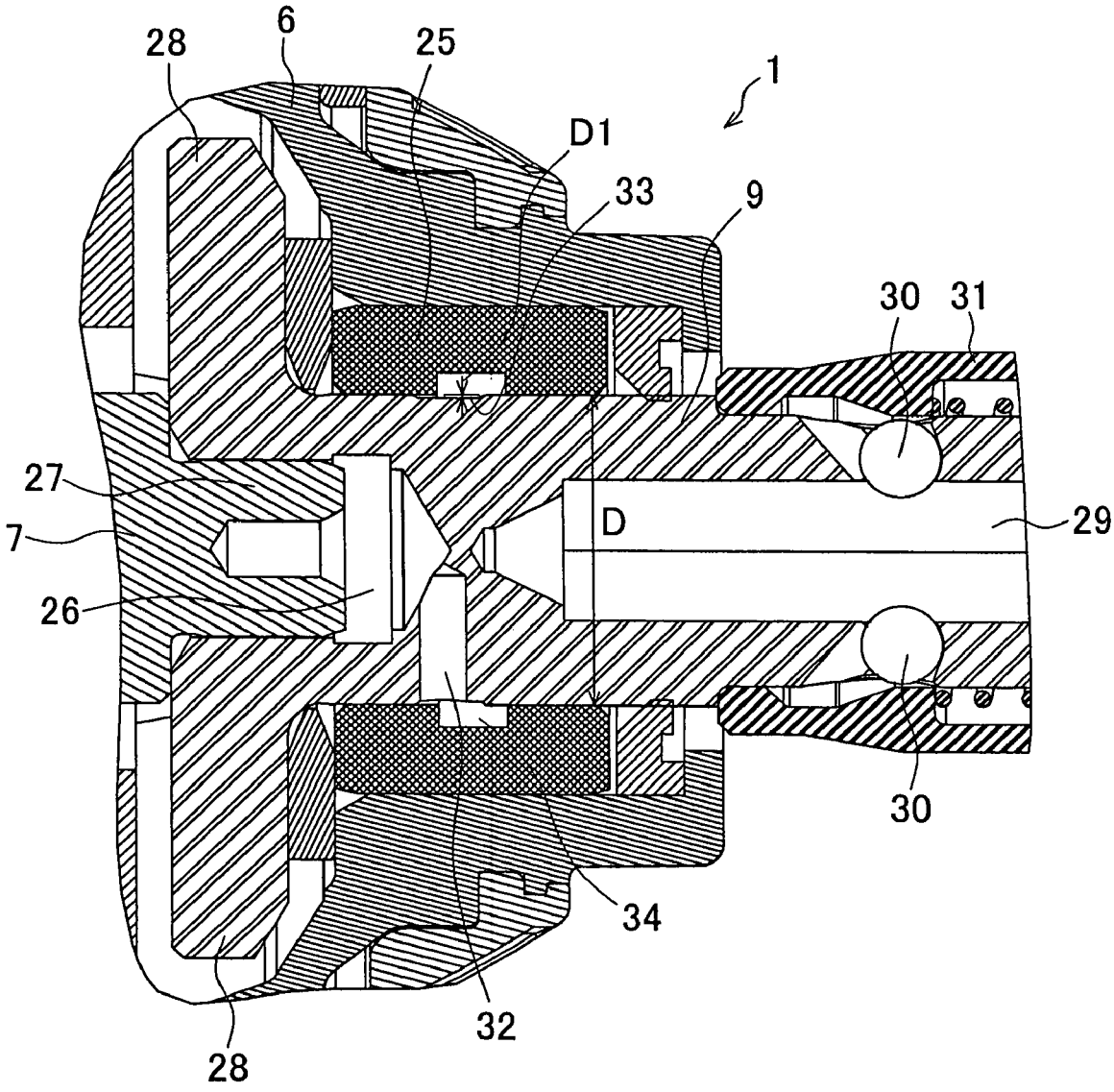
FIG. 2 is an enlarged view partly showing an anvil according to the first embodiment.

Provided in the anvil 9 between the bearing hole 26 and the insertion hole 29 is a connecting opening 32. As best seen in FIG. 2, the connecting opening 32 radially extends in the anvil 9, and one end of the connecting opening 32 communicates with a tapered portion of the bearing hole 26 while the other end of the connecting opening 32 opens to a ring-shaped outer groove 33 formed on the outer peripheral surface of the anvil 9. A ring-shaped receiving groove 34 is also formed on the inner peripheral surface of the metal bearing 25 in such a position where the receiving groove 34 and the outer groove 33 of the anvil 9 overlap each other along the axial direction of the anvil 9. Therefore, the bearing hole 26 communicates with the receiving groove 34 of the metal bearing 25 through the connecting opening 32 and the outer groove 33. According to this embodiment, the outer groove 33 of the anvil 9 is formed to have a depth D1 in the range of 3-10% of the outer diameter D of the anvil 9, which is deeper than a conventional type anvil, and the connecting opening 32 opens at the rear end of the outer groove 33 in the axial direction of the anvil 9. In other words, the connecting opening 32 is set back compared to the conventional connecting opening. By this parallel and backward displacement of the connecting opening 32, it is possible to set back the insertion hole 29. This enables the overall length of the anvil 9 to be shortened by approximately 1 mm compared to the conventional type anvil, even if the insertion hole 29 is set to have the same depth as that of the conventional anvil.

The depth D1 of the outer groove 33 of the anvil 9 is set in the range of 3-10% of the outer diameter D of the anvil 9. If the depth D1 is smaller than 3%, a grease supply passage required for lubrication cannot ensure a sufficient sectional area, and therefore a necessary amount of grease is not supplied to the receiving groove 34 of the metal bearing 25. Meanwhile, if the depth D1 is greater than 10%, the outer groove 33 is so deep that grease is apt to accumulate in the outer groove 33, and therefore a necessary amount of grease cannot be supplied to the receiving groove 34.

According to the impact driver 1 as described above, when the switch trigger 13 is operated, the motor 4 is driven to rotate. The rotation of the output shaft 5 of the motor 4 is then transmitted to the spindle 7 through the planetary gears 19, 19, so that the spindle 7 rotates. The rotation of the spindle 7 is then transmitted to the hammer 21 through the balls 24, 24 and causes the hammer 21 to rotate, so that the anvil 9 engaged with the hammer 21 also rotates. Therefore, a screw-tightening operation, etc. can be performed using a bit attached to the front end of the anvil 9. As the screw-tightening operation proceeds and a load applied to the anvil increases to a certain threshold, the hammer 21 is repeatedly disengaged from and reengaged with the flanges 28, 28 of the anvil 9 to provide an intermittent rotary impact force. This intermittent rotary impact force provides a retightening function of the impact driver 1.

Grease filled in the hammer case 6 accumulates in the bearing hole 26, and by the centrifugal force due to rotation of the anvil 9, the grease passes through the connecting opening 32 and is discharged into the outer groove 33. The grease is then supplied to the receiving groove 34 of the metal bearing 25 which is in communication with the outer groove 33. Accordingly, lubrication between the outer peripheral surface of the anvil 9 and the inner peripheral surface of the metal bearing 25 is maintained. In this embodiment, even if the connecting opening 32 opens at the rear end of the outer groove 33, the lubrication between the anvil 9 and the metal bearing 25 is maintained without any problems because a necessary sectional area of the grease supply passage is ensured by the deep outer groove 33.

According to the impact driver 1 as described above in this embodiment, the outer groove 33 is formed to have a depth in the range of 3-10% of the outer diameter of the anvil 9, and the connecting opening 32 is set back so as to open at the rear end of the outer groove 33 in the axial direction of the anvil 9. Therefore, the overall length of the anvil 9 can be reduced while ensuring necessary lubrication between the anvil 9 and the metal bearing 25, and the whole size of the impact driver 1 can be downsized.

According to this embodiment, only one connecting opening 32 is provided in the anvil 9. However, a plurality of connecting openings 32 may be provided in the anvil 9.

Other embodiments of the present invention will be described below. Parts similar to those previously described in the first embodiment are denoted by the same reference numerals, and detailed description thereof will be omitted.

Second Embodiment

Figure 3:
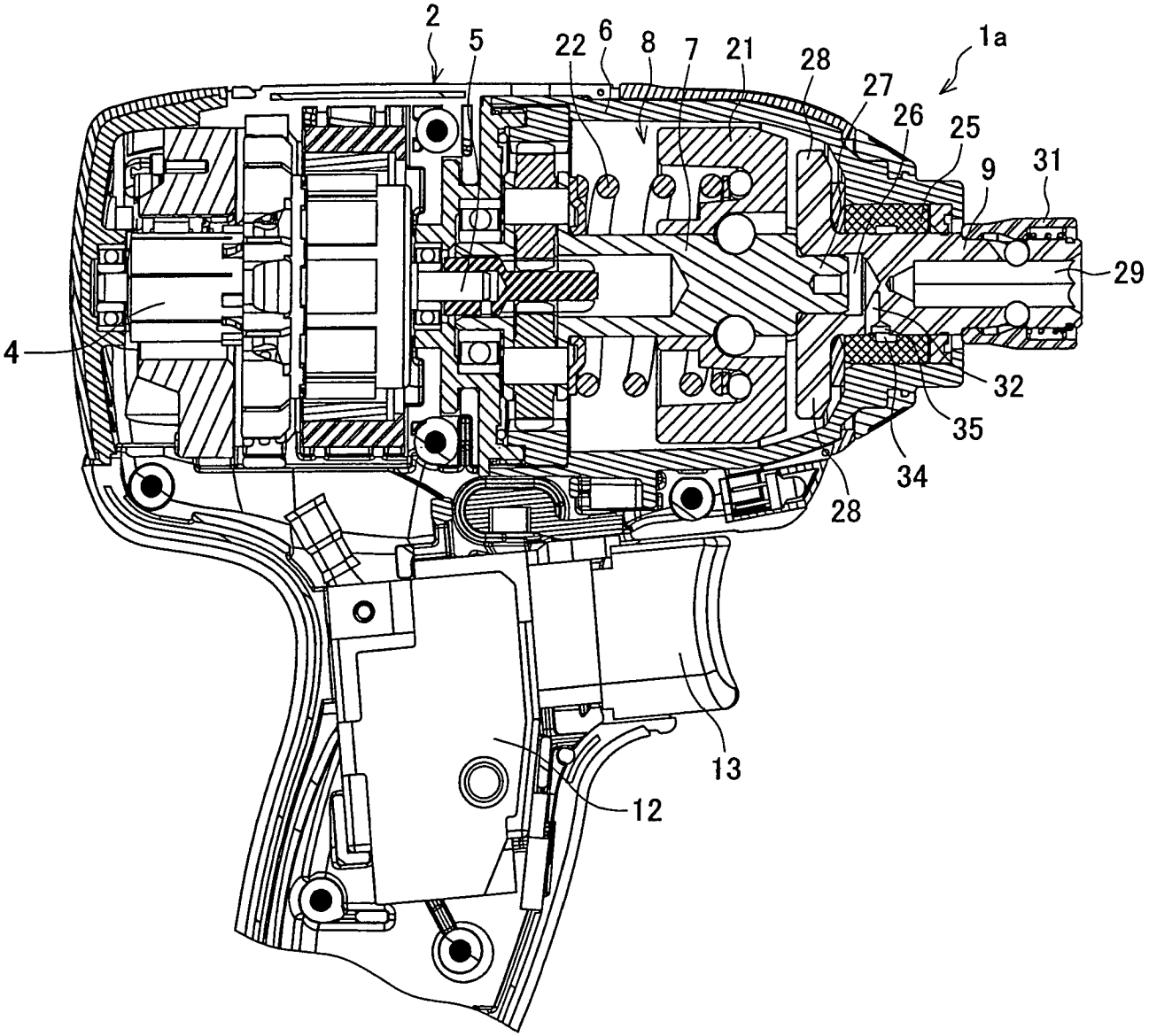
FIG. 3 is a longitudinal sectional view partly showing an impact driver according to a second embodiment of the present invention.
Figure 4:
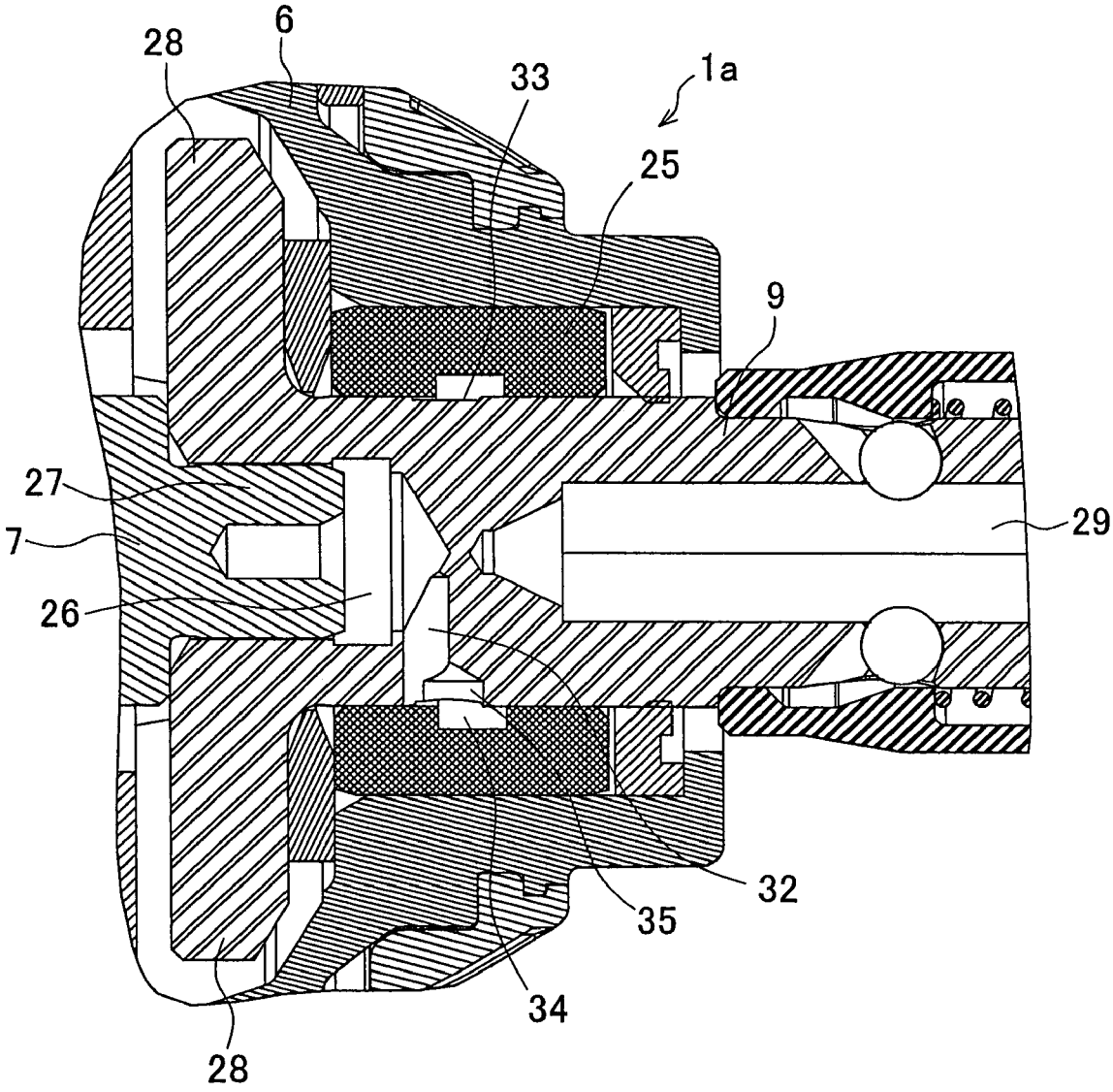
FIG. 4 is an enlarged view partly showing an anvil according to the second embodiment.

According to an impact driver 1*a* as shown in FIGS. 3 and 4, the outer groove 33 of the anvil 9 is not as deep as that of the first embodiment and has the same depth as that of the conventional outer groove. However, an opening portion 35 of the connecting opening 32 communicating with the outer groove 33 is enlarged. To be more specific, the opening portion 35 has a diameter slightly greater than that of the connecting opening 32 and the bottom portion thereof is in communication with the connecting opening 32. The enlarged opening portion 35 extends in a direction toward a front side of the connecting opening 32 in the axial direction of the anvil 9.

Further, the connecting opening 32 opens at the rear end of the outer groove 33 in the axial direction of the anvil 9. To be more specific, the connecting opening 32 is set back compared to the conventional connecting opening, so as to open at the rear end of the outer groove 33 in the axial direction of the anvil 9.

According to this embodiment, an outlet of the connecting opening 32 to the outer groove 33 is enlarged at the opening portion 35, so that a necessary sectional area of the grease supply passage is ensured.

Grease filled in the hammer case 6 passes through the bearing hole 26, the connecting opening 32 and the enlarged opening portion 35 in this order, and is discharged into the outer groove 33. The grease is then supplied to the receiving groove 34 of the metal bearing 25 which is in communication with the outer groove 33. Accordingly, sufficient lubrication between the outer peripheral surface of the anvil 9 and the inner peripheral surface of the metal bearing 25 is maintained. In this embodiment, even if the connecting opening 32 opens at the rear end of the outer groove 33, the lubrication between the anvil 9 and the metal bearing 25 is maintained without any problem because a necessary sectional area of the grease supply passage is ensured by the enlarged opening portion 35.

According to the impact driver 1*a* as described above in this embodiment, the opening portion 35 of the connecting opening 32 communicating with the outer groove 33 is enlarged, and the connecting opening 32 is set back so as to open at the rear end of the outer groove 33 in an axial direction of the anvil 9. Therefore, the overall length of the anvil 9 can be reduced while necessary lubrication is ensured between the anvil 9 and the metal bearing 25, and the whole size of the impact driver 1*a* can be downsized.

According to this embodiment, the enlarged opening portion 35 is formed at the front side of the connecting opening 32. However, as long as a necessary sectional area of the grease supply passage is ensured, the opening portion 35 may be formed coaxially with the connecting opening 32. Further, instead of enlarging the opening portion 35 in the front-and-rear direction of the connecting opening 32, the opening portion 35 may be enlarged in the right-and-left direction of the connecting opening 32. Of course, the number of the connecting opening 32 with this enlarged opening portion 35 is not limited to one, and a plurality of such connecting openings 32 may be provided in the anvil 9.

Third Embodiment

Figure 5:
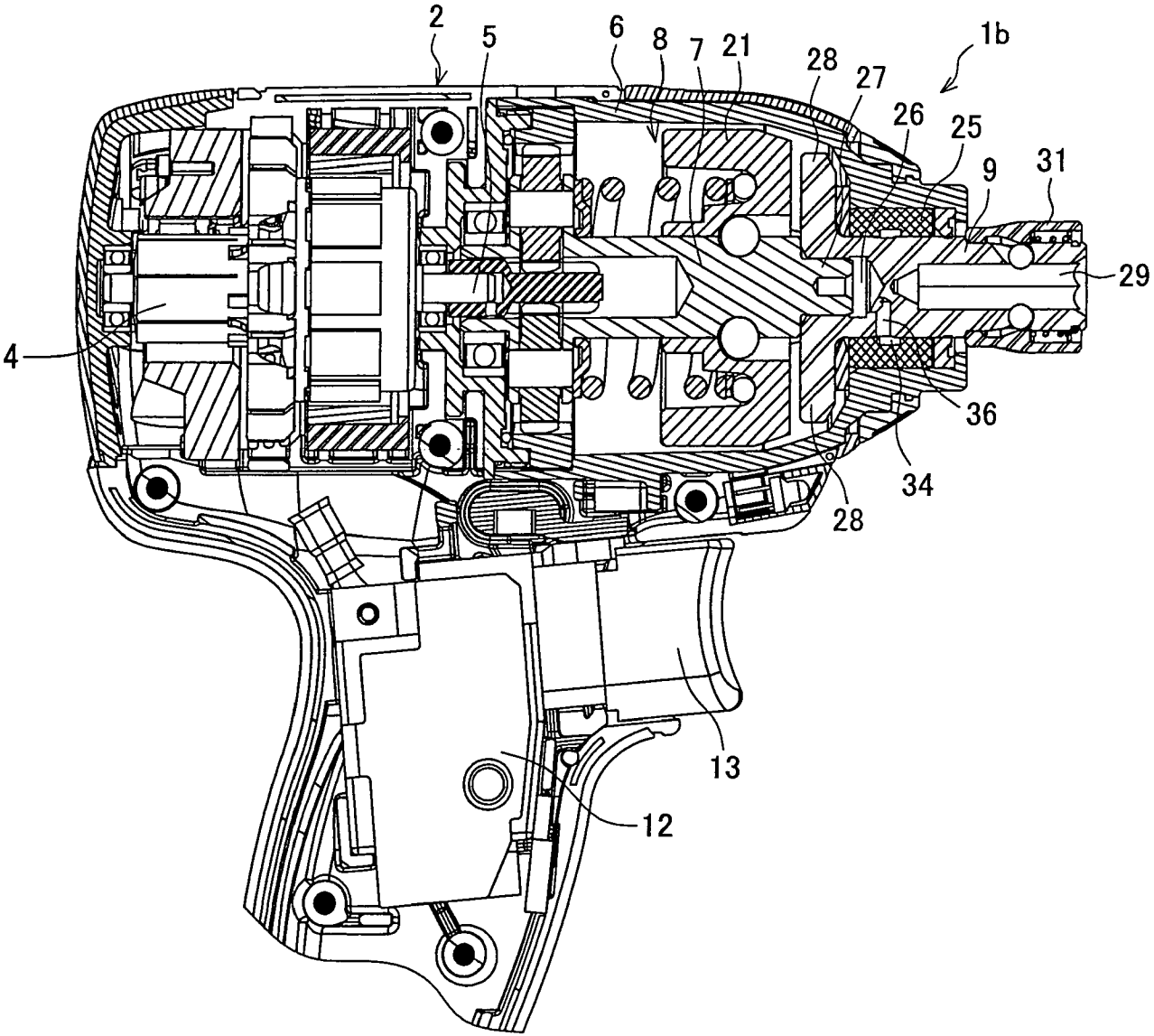
FIG. 5 is a longitudinal sectional view partly showing an impact driver according to a third embodiment of the present invention.
Figure 6:
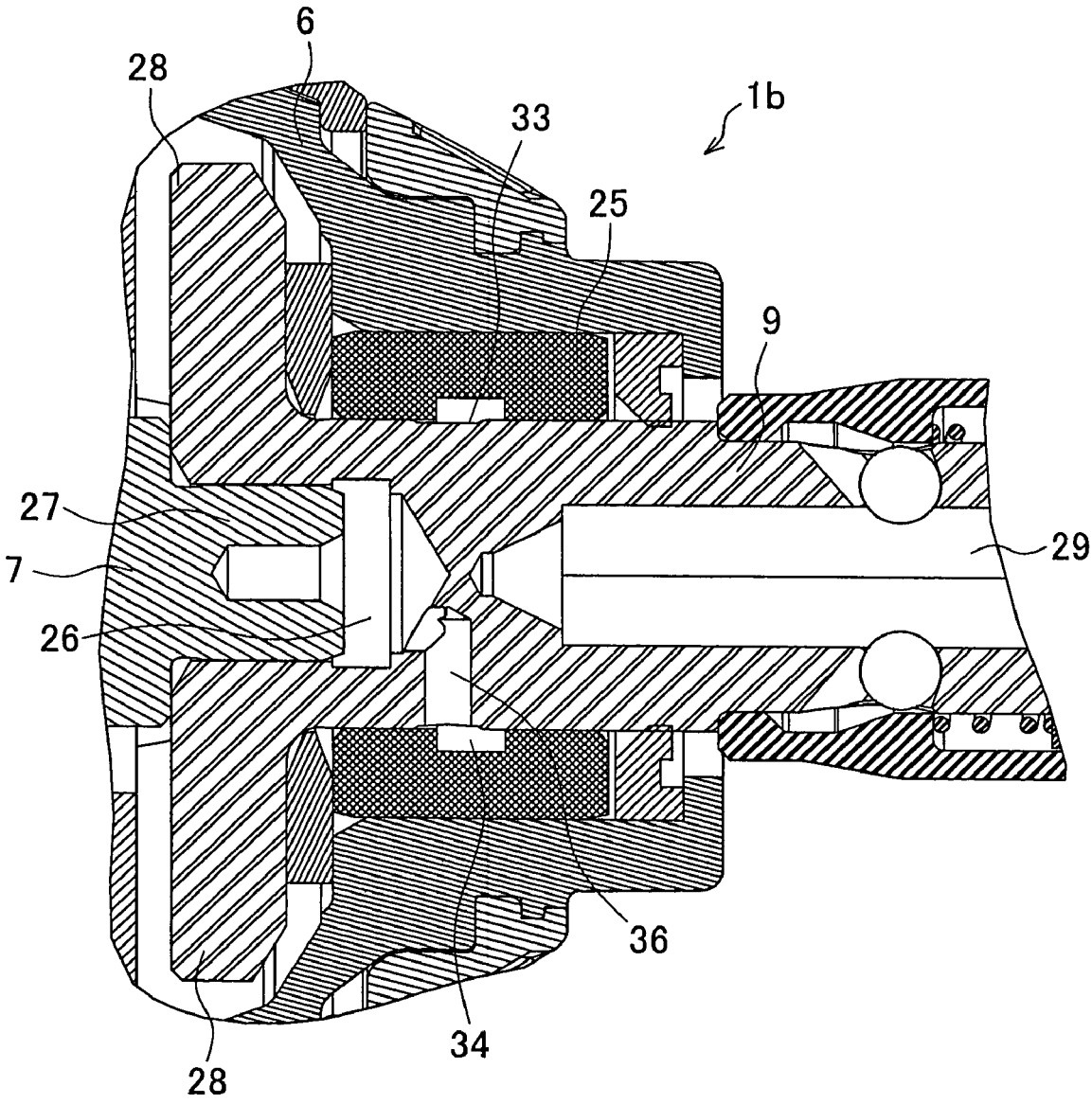
FIG. 6 is an enlarged view partly showing an anvil according to the third embodiment.

According to an impact driver 1*b* as shown in FIGS. 5 and 6, a connecting opening 36 radially extends in the anvil 9 from the surface of the outer groove 33. The connection opening 36 is formed in the same position of the outer groove 33 compared to the conventional connecting opening. However, instead of directly connecting the connecting opening 36 to the bearing hole 26, one end of the connecting opening 36 is bent rearward at 90 degrees at a position close to the axis of the anvil 9 and connected to the bearing hole 26, so that the connecting opening 36 is formed in the shape of L.

According to the configuration of this embodiment, interference between the end of the connecting opening 36 close to the axis of the anvil 9 and the insertion hole 29 can be prevented, and this can enable the insertion hole 29 to be set back.

Grease filled in the hammer case 6 passes through the bearing hole 26 and the connecting opening 36, and is discharged into the outer groove 33. The grease is then supplied to the receiving groove 34 of the metal bearing 25 which is in communication with the outer groove 33. Since the connecting opening 36 opens at the same position in the outer groove 33 as that of the conventional connecting opening, the lubrication between the anvil 9 and the metal bearing 25 is maintained.

According to the impact driver 1*b* as described above in this embodiment, one end of the connecting opening 36 is bent rearward at a position close to the axis of the anvil 9 and connected to the bearing hole 26. Therefore, the overall length of the anvil 9 can be reduced while ensuring necessary lubrication between the anvil 9 and the metal bearing 25, and the whole size of the impact driver 1*b* can be downsized.

The connecting opening 36 is not limited to be L-shaped with a bent angle of 90 degrees. The connecting opening 36 may be bent at different angles other than 90 degrees by increasing or decreasing the bent angle. Further, the connecting opening 36 may be bent arcuately. Of course, a plurality of connecting openings 36 may be provided in the anvil 9.

Fourth Embodiment

Figure 7:
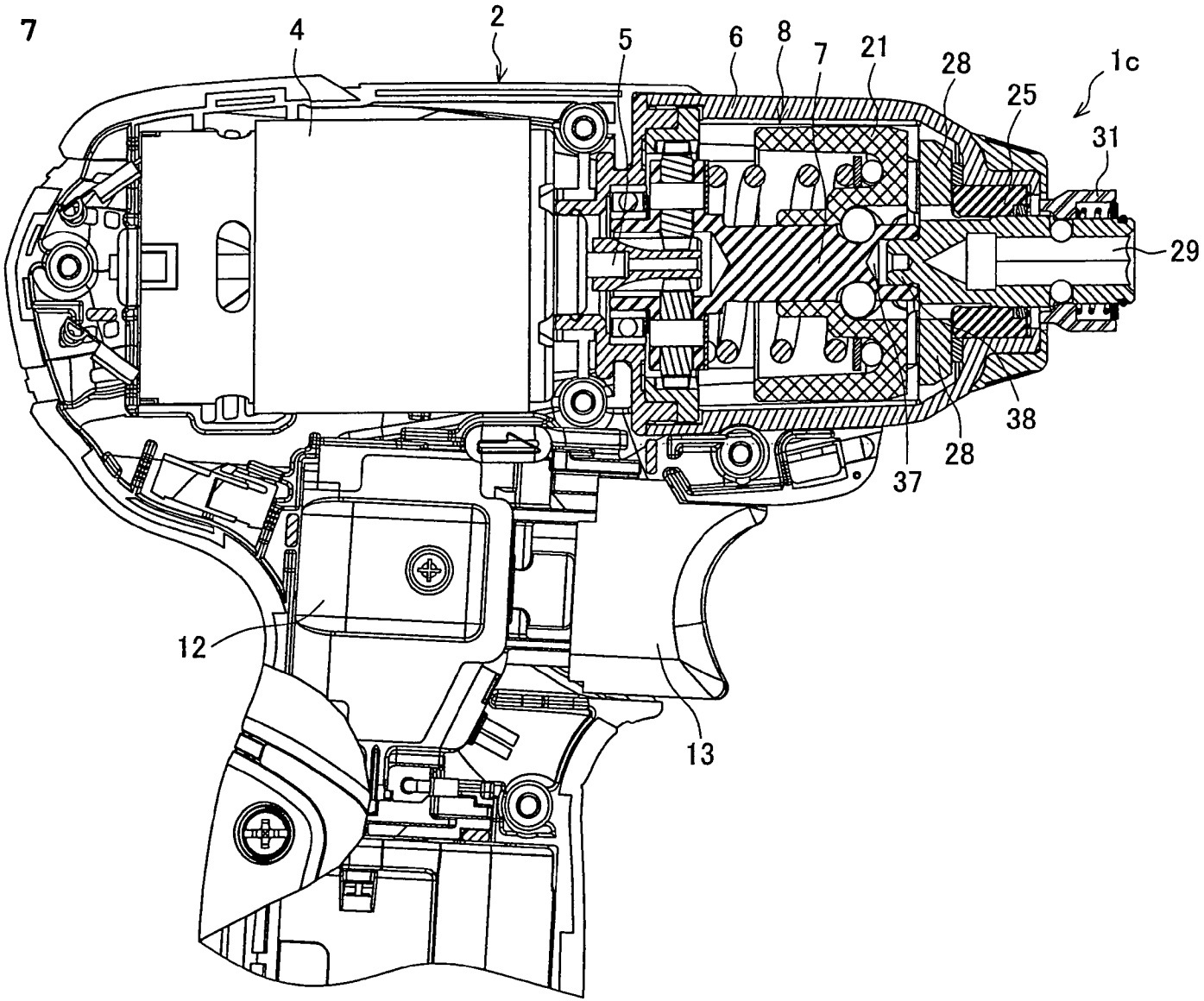
FIG. 7 is a longitudinal sectional view partly showing an impact driver according to a fourth embodiment of the present invention.
Figure 8:
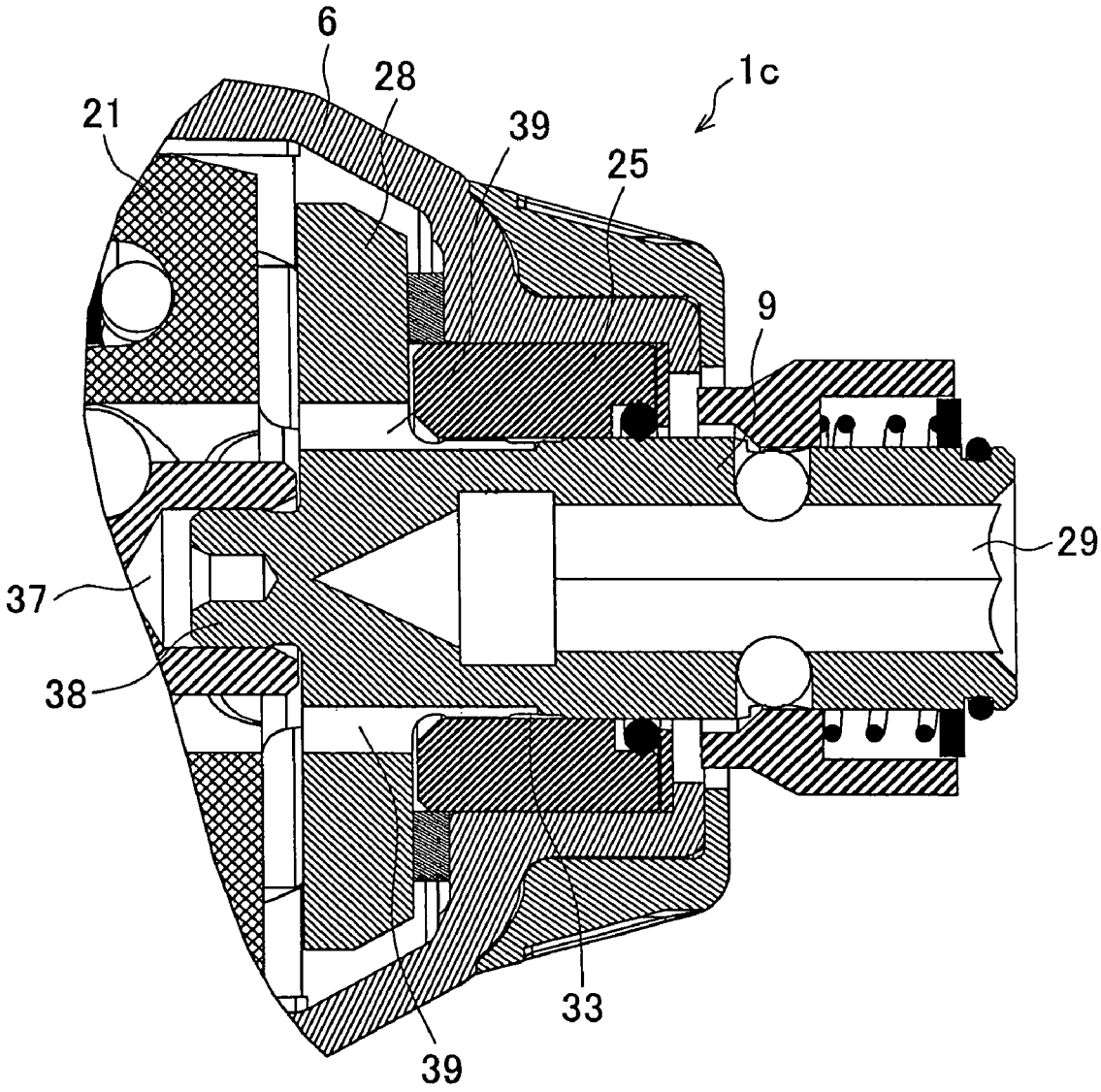
FIG. 8 is an enlarged view partly showing an anvil according to the fourth embodiment.
Figure 9:
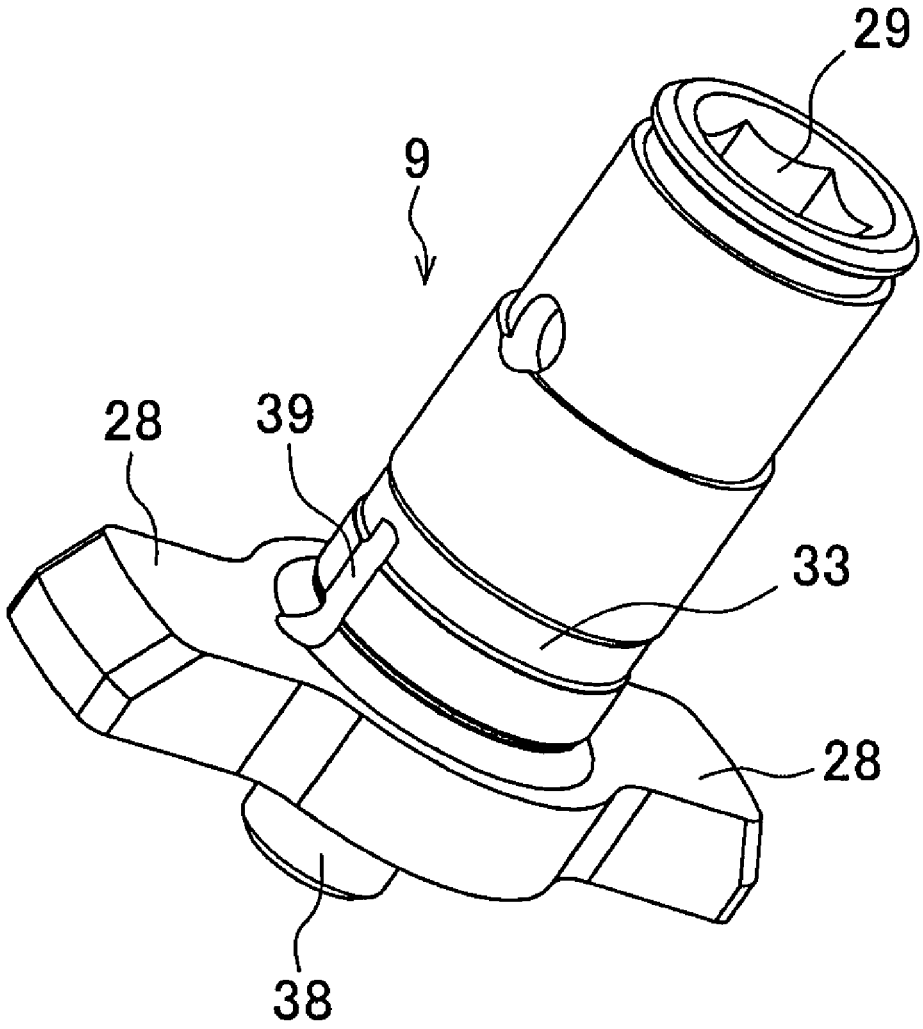
FIG. 9 is a perspective view of the anvil according to the fourth embodiment.
Figure 10B:
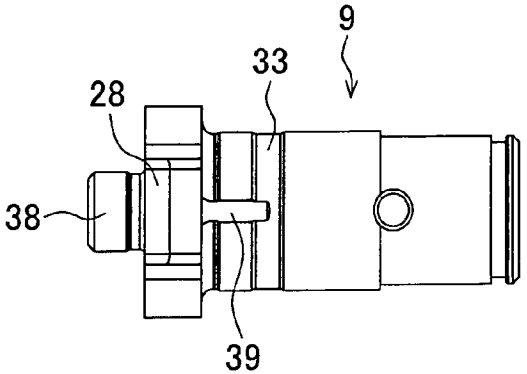
Figure 10C:
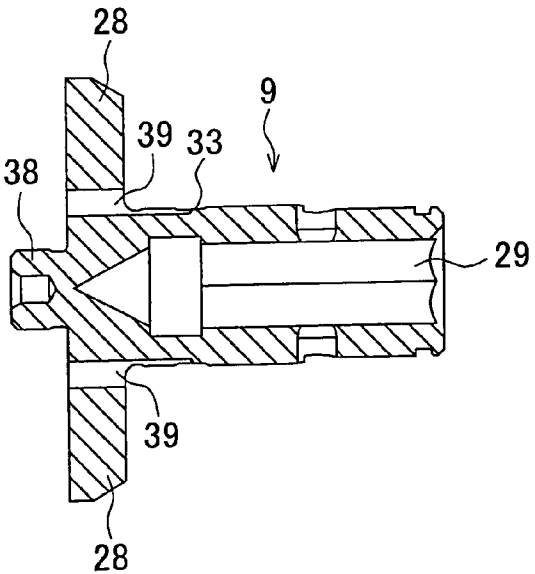
Figure 10A:
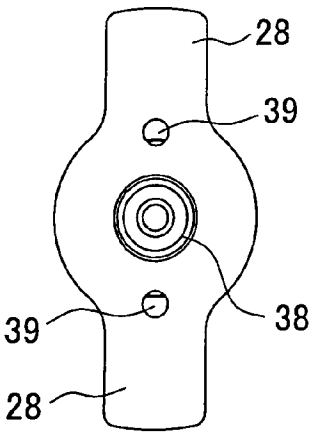

According to an impact driver 1*c* as shown in FIGS. 7 and 8, the engagement between the spindle 7 and the anvil 9 are reversely made compared to those of the first to third embodiments. To be more specific, a bearing hole 37 is coaxially formed in the spindle 7 at the front end surface of the spindle 7, whereas a small-diametered portion 38 is provided at the rear end surface of the anvil 9 so as to be rotatably supported in the bearing hole 37.

As best seen in FIG. 9 and FIGS. 10A to 10C, a radially extending connecting opening is not provided in the anvil 9. Instead, a pair of communication passages 39, 39 are formed on the outer periphery of the anvil 9. Each communication passage 39 extends from the rear end of the anvil except for the region on the small-diametered portion 38, penetrating through the flange 28 in the axial direction of the anvil 9, and reaches the outer groove 33. The communication passages 39, 39 are symmetrically provided with respect to the axis of the anvil 9. Through these communication passages 39, 39, the outer groove 33 communicates with the inner region of the hammer case 6 at the rear side of the anvil 9.

Grease filled in the hammer case 6 passes through the communication passages 39, 39, and is discharged into the outer groove 33, from which the grease is supplied to the inner peripheral surface of the metal bearing 25. Therefore, the lubrication between the anvil 9 and the metal bearing 25 is maintained.

According to the impact driver 1*c* as described above in this embodiment, the communication passages 39, 39 are formed on the outer periphery of the anvil 9 so as to communicate the outer groove 33 with the inner region of the hammer case 6 at the rear side of the anvil 9. This can eliminate the need for providing a connecting opening within the anvil 9. Therefore, the overall length of the anvil 9 can be reduced while ensuring necessary lubrication between the anvil 9 and the metal bearing 25, and the whole size of the impact driver 1*c* can be downsized.

The number of communication passages 39, 39 may be increased or decreased. Further, the communication passages 39, 39 may not penetrate through the flanges 28, 28. For example, each communication passage 39 may be provided over the flange 28 in such a manner that an elongated groove is bent at 90 degrees at the flange 28 and extends along the surface of the flange 28. Of course, these modifications may be combined together.

Although the present invention has been described in detail with reference to the above preferred embodiments, the present invention is not limited to the above specific embodiments and various changes and modifications may be made without departing from the scope of the appended claims. For example, in the first to fourth embodiments, it is not necessary that the housing includes the main body housing 2 and the hammer case 6. As an alternative, an integrated housing may be employed, in which the main body housing and the hammer case are integrated. Also, the housing may not include an extension portion. Changes or modifications may be made to the housing and/or the impact mechanism where necessary. Of course, the present invention is not limited to an impact driver, and is applicable to other impact tools such as an angle impact driver and an impact wrench.

What is claimed is:

1. An impact tool comprising:

a spindle disposed in a housing and configured to be rotated by a motor;

an anvil disposed in front of the spindle and rotatably supported by the housing through a metal bearing in a manner coaxial with the spindle, a front end of the anvil having an insertion hole for attaching a bit and protruding from a front side of the housing, and a rear surface of the anvil having a bearing hole in which a front end of the spindle is rotatably supported in a manner coaxial with the anvil;

an impact mechanism configured to transmit a rotation of the spindle as a rotary impact force to the anvil;

a ring-shaped outer groove formed on an outer periphery of the anvil and opposed to an inner peripheral surface of the metal bearing; and at least one connecting opening radially extending in the anvil and connecting the bearing hole and the outer groove to provide a communication therebetween, wherein the outer groove is formed to have a depth in the range of 3 to 10% of an outer diameter of the anvil, and the connecting opening opens at a rear end of the outer groove in an axial direction of the anvil.

2. An impact tool according to claim 1, wherein the impact mechanism comprises a hammer fitted at a front part of the spindle, a plurality of balls received between a groove formed on an inner surface of the hammer and a corresponding groove formed on an outer surface of the spindle, a coil spring urging the hammer toward a front side of the impact tool, and a pair of flanges radially extending at a rear end of the anvil so that the hammer is engaged with the flanges.

3. An impact tool according to claim 1, wherein a chuck mechanism is provided at a front side of the anvil so as to prevent the bit inserted into the insertion hole from coming off from the anvil.

4. An impact tool according to claim 1, wherein a receiving groove is formed on the inner peripheral surface of the metal bearing in such a position where the receiving groove and the outer groove of the anvil overlap each other along the axial direction of the anvil.

5. An impact tool according to claim 1, wherein a plurality of the connecting openings are provided in the anvil.

* * * * *